US007518322B2

(12) United States Patent
Kodaka et al.

(10) Patent No.: US 7,518,322 B2
(45) Date of Patent: Apr. 14, 2009

(54) OPERATION CIRCUIT FOR A WORK VEHICLE

(75) Inventors: Katsuaki Kodaka, Tsuchiura (JP); Kazuhiro Ichimura, Niihari-gun (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 399 days.

(21) Appl. No.: 10/998,046

(22) Filed: Nov. 29, 2004

(65) Prior Publication Data

US 2005/0122068 A1 Jun. 9, 2005

(30) Foreign Application Priority Data

Dec. 4, 2003 (JP) ..... 2003-405683

(51) Int. Cl.
*H02P 1/54* (2006.01)

(52) U.S. Cl. ..... 318/34; 180/53.4; 180/53.5; 180/69.6

(58) Field of Classification Search ..... 318/34; 180/53.4, 53.5, 69.6, 306
See application file for complete search history.

(56) References Cited

U.S. PATENT DOCUMENTS

| | | | | |
|---|---|---|---|---|
| 4,134,505 | A * | 1/1979 | Watanabe | 414/715 |
| 4,558,758 | A * | 12/1985 | Littman et al. | 180/8.1 |
| 4,949,805 | A * | 8/1990 | Mather et al. | 180/333 |
| 5,590,731 | A * | 1/1997 | Jacobson | 180/53.4 |
| 5,934,403 | A * | 8/1999 | Moore et al. | 180/336 |
| 6,311,795 | B1 * | 11/2001 | Skotnikov et al. | 180/8.3 |
| 6,354,081 | B1 * | 3/2002 | Burton | 60/427 |
| 7,104,548 | B2 * | 9/2006 | Ichimura et al. | 280/6.154 |

FOREIGN PATENT DOCUMENTS

| | | |
|---|---|---|
| DE | 100 12 389 A1 | 9/2001 |
| EP | 0 860 557 A1 | 8/1998 |
| EP | 0 989 242 A1 | 3/2000 |
| JP | U-64-20561 | 2/1989 |
| JP | U-4-95161 | 8/1992 |
| JP | 08-290723 | 11/1996 |
| JP | 09-115374 | 5/1997 |
| JP | 2793868 | 6/1998 |
| JP | A-10-331203 | 12/1998 |
| JP | A-63-312430 | 12/1998 |
| JP | 2002-307931 | 10/2002 |

* cited by examiner

*Primary Examiner*—Bentsu Ro
*Assistant Examiner*—Thai Dinh
(74) *Attorney, Agent, or Firm*—Oliff & Berridge, PLC

(57) ABSTRACT

An operation circuit for a work vehicle drives an electromagnetic actuator by generating an operation signal corresponding to a switch operation and drives a work actuator in response to the drive of the electromagnetic actuator. By installing a specific detachable electric circuit unit in a first operation circuit that generates a first operation signal in response to an operation of a specific switch, the first operation circuit can be modified to a second operation circuit that generates a second operation signal different from the first operation signal in response to an operation of the same switch.

4 Claims, 7 Drawing Sheets

OPERATION CIRCUIT FOR A WORK VEHICLE

BACKGROUND OF THE INVENTION

1. Field of the Invention

The present invention relates to an operation circuit for a work vehicle, which generates an operation signal that corresponds to a switch operation.

2. Description of the Related Art

There is a switching device known in the related art that can switch operation signals according to changes made in the specifications of a vehicle (see Japanese Laid Open Patent Publication No. H 8-290723). In this device, an operation circuit is formed in conformance to the basic specifications according to which the shift lever is disposed on the left side. When the shift lever is disposed on the right side, the operation signal path is changed by inserting an auxiliary connector in the path of the operation signals. More specifically, the forward travel operation signal is switched to the reverse travel operation signal, and the reverse travel operation signal is switched to the forward travel operation signal.

SUMMARY OF THE INVENTION

The types of actuators that can be mounted at a given work vehicle such as a hydraulic shovel are many and diverse. Since the work vehicle operates in various work modes in correspondence to the different types of actuators, diverse switch functions need to be achieved. For instance, a given type of actuator may need to be driven only while the switch is being operated, whereas another type of actuator may need to be continuously driven even if the operator operates the switch and then releases it. Accordingly, it is desirable to ensure that the switch functions can be changed readily.

However, the switching device described above, with which the forward travel operation signal and the reverse travel operation signal are switched by using an auxiliary connector inserted in the signal path, does not modify the switch functions themselves.

The operation circuit according to the present invention, which is an operation circuit for a work vehicle used to drive an electromagnetic actuator by generating an operation signal corresponding to a switch operation and ultimately drive a work actuator as the electromagnetic actuator is driven, is characterized in that a specific detachable electric circuit unit is installed in a first operation circuit via connectors which generates a first operation signal in response to an operation of a specific switch to change the first operation circuit to a second operation circuit which generates a second operation signal different from the first operation signal in response to an operation of the same switch.

The first operation circuit can be modified to the second operation circuit by replacing an electric circuit unit included in the first operation circuit which is disposed between the switch and the electromagnetic actuator, with the specific electric circuit unit. The electric circuit unit desirably includes a relay circuit.

The first operation signal may be an operation signal in response to which a drive command for driving the work actuator is output while the switch operation is sustained, and the second operation signal may be an operation signal in response to which the drive, command for driving the work actuator is continuously output once the switch operation is performed even if the switch operation stops.

The first operation signal may be an operation signal used to issue a command for a specific operation of the work actuator in response to the switch operation, and the second operation signal maybe an operation signal used to issue a command for another operation in addition to the specific operation of the work actuator.

The second operation circuit can include a selector switch operated to select a single work actuator among a plurality of work actuators, and the first operation signal can be an operation signal in response to which a drive command for driving a specific work actuator is output and the second operation signal can be an operation signal in response to which a drive command for driving a work actuator selected with the selector switch is output.

An operation circuit for a work vehicle according to the present invention includes a switch device, an electromagnetic actuator driven in response to a command issued through the switch device, an electric circuit unit disposed between the switch device and the electromagnetic actuator, which controls drive of the electromagnetic actuator in response to a command issued through the switch device, and a connector device that individually connects the switch device with the electric circuit unit and the electric circuit unit with the electromagnetic actuator. In this operation circuit for a work vehicle, a mode in which the electromagnetic actuator is driven in response to the command from the switch device is modified by replacing the electric circuit unit with another electric circuit unit via the connector device.

DETAILED DESCRIPTION OF THE PREFERRED EMBODIMENT

The following is an explanation of embodiment of the operation circuit for a work vehicle according to the present invention given in reference to FIGS. 1 through 8.

Figure 1:
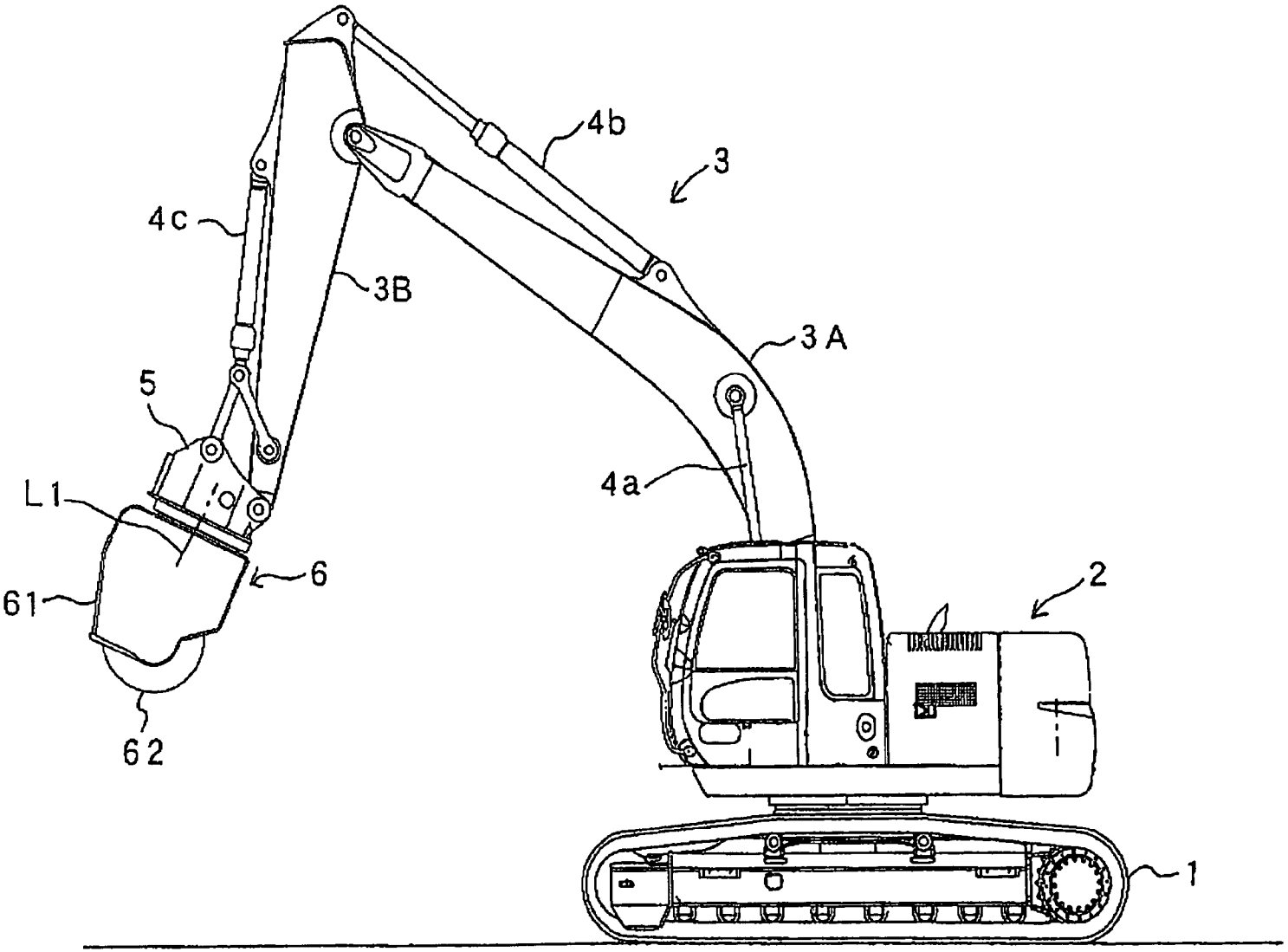
FIG. 1 is a side elevation of a mowing machine in which the present invention may be adopted.

FIG. 1 is a side elevation of a mowing machine adopting the present invention, which is achieved by using a hydraulic shovel as a base machine. The hydraulic shovel constituting the base machine includes a traveling superstructure 1, a revolving superstructure 2 rotatably disposed on top of the traveling superstructure 1 and a front work device 3 rotatably disposed at the revolving superstructure 2. The front work device 3 includes a boom 3A axially supported via a boom cylinder 4*a* at the revolving superstructure 2 so as to be allowed to rotate, an arm 3B axially supported via an arm cylinder 4*b* at the front end of the boom 3A so as to be allowed to rotate and a mower main unit 6.

The mower main unit 6 is rotatably supported at a work device cylinder 4*c* via a bracket 5 axially supported at the front end of the arm 3B, and includes a cover 61 and a rotating body 62. The rotating body 62 is rotatably supported by the cover 61. A cutter is attached to the rotating body 62 and thus, grass is cut with the cutter as the rotating body 62 rotates. The rotating body 62 is caused to rotate as a hydraulic motor, not shown, (hereafter referred to as a rotating body motor) is driven.

The cover 61 is disposed so that it is allowed to rotate around an axial line L1 relative to the bracket 5. As a hydraulic motor, not shown, (hereafter referred to as a cover motor) is driven, the cover 61 rotates as one with the rotating body 62, thereby altering the orientation of the rotating body 62 relative to the vehicle body. In addition, a pair of tilt cylinders, i.e., a left tilt cylinder and a right tilt cylinder (not shown) is provided at the mower main unit 6. As the tilt cylinders are driven, the tilt angle of the rotating body 62 relative to the horizontal plane changes.

Figure 2A:
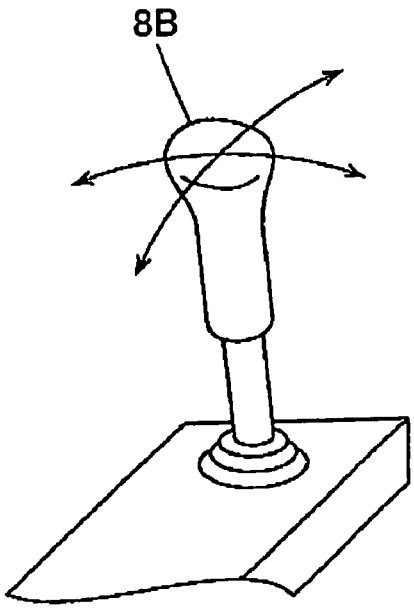
FIG. 2 shows operation levers provided in the mowing machine shown in FIG. 1.
Figure 2B:
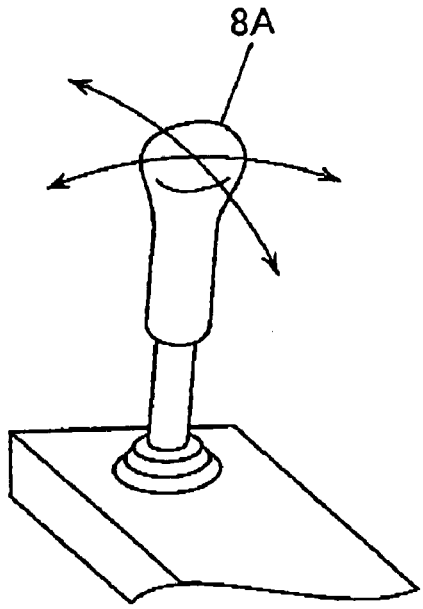

FIGS. 2A and 2B respectively show operation levers 8B and 8A, the two operation levers used to operate the cylinders 4*a* to 4*c* and a hydraulic motor (not shown) for engaging the revolving superstructure 2 in a revolving motion. The operation levers 8A and 8B are disposed by the operator's seat. As indicated with the arrows in the figures, the operation levers 8A and 8B can each be operated along four directions perpendicular to one another. In response to operations of the operation levers 8A and 8B, the boom cylinder 4*a*, the arm cylinder 4*b*, the work device cylinder 4*c* and the revolving motion hydraulic motor are individually driven.

Figure 3A:
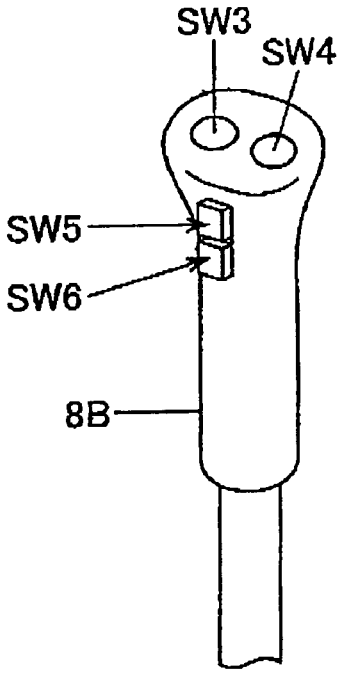
FIG. 3 shows the arrangement of the switches disposed at the operation levers in FIG. 2.
Figure 3B:
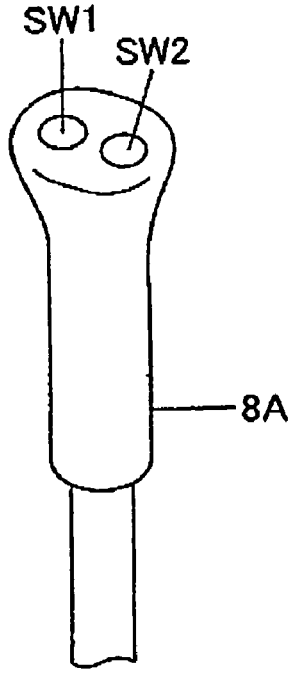

FIGS. 3A and 3B show switches disposed at the operation levers 8B and 8A. As shown in FIG. 3A, push-type switches sw3 to sw6 are provided at the grip of the operation lever 8B. As shown in FIG. 3B, push-type switches sw1 and sw2 are disposed at the grip of the operation lever 8A. The operator is able to operate the switches sw1 to sw6 while holding the operation levers 8A and 8B. Through operations of the switches sw1 to sw6, drive commands for driving the rotating body motor, the cover motor and the tilt cylinders described earlier are output.

It is to be noted that the switches sw3 and sw4 are used as a pair whereas the switches sw5 and sw6 are used as another pair, with the switches sw3 and sw4 disposed on the top of the grip and the switches sw5 and sw6 disposed on the side of the grip. Accordingly, the operator is able to operate either the switch sw3 or the switch sw4 and either the switch sw5 or the switch sw6 at once with one hand. It is to be noted that the switches sw1 to sw6 may be provided at locations other than the operation levers 8A and 8B.

In the embodiment, the operation circuit that generates operation signals can be modified. The following explanation focuses on this feature.

(1) Basic Specifications

Figure 4:
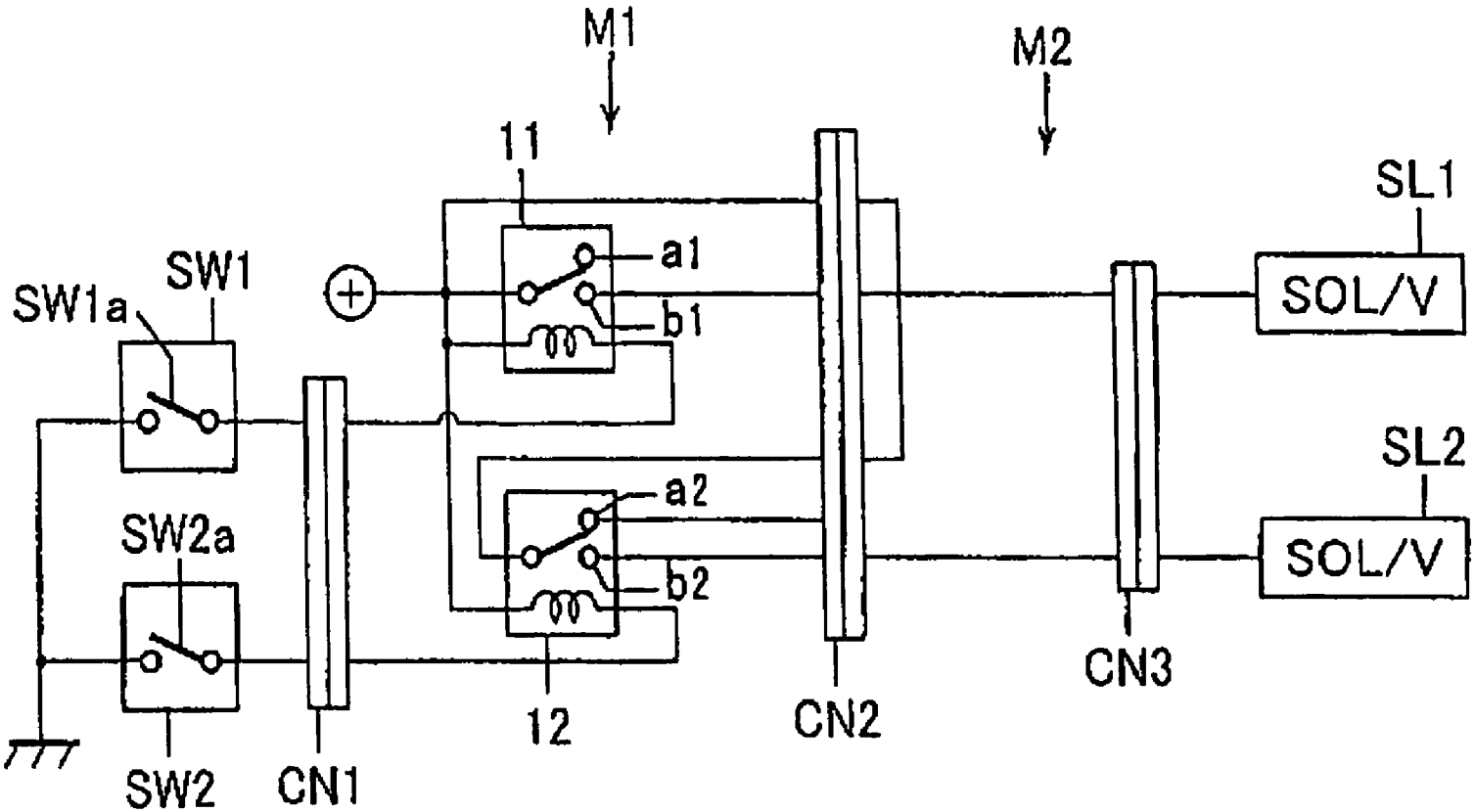
FIG. 4 shows the structure of the operation circuit conforming to the basic specifications, as achieved in an embodiment.

The operation circuit conforming to the basic specifications is now explained in reference to FIG. 4. According to the basic specifications, a drive command for driving the rotating body motor is output through an operation of the switch sw1 or sw2 disposed at the operation lever 8A. In addition, a drive command for driving the cover motor is output through an operation of the switch sw3 or sw4 disposed at the operation lever 8B and a drive command for driving the tilt cylinders is output through an operation of the switch sw5 or sw6 disposed at the operation lever 8B.

FIG. 4 shows an operation circuit that generates an operation signal for the rotating body motor in response to a switch operation at the operation lever 8A. Solenoids SL1 and SL2 are utilized for electromagnetic switching valves used to control, for instance, the direction along which pressure oil from a hydraulic pump flows toward the rotating body motor As shown in FIG. 4, the switches sw1 and sw2 are connected with an electric circuit unit M1 having a relay circuit via a connector CN1. An electric circuit unit M2 is connected to the electric circuit unit M1 via a connector CN2, and the solenoids SL1 and SL2, in turn, are connected to the electric circuit unit M2 via a connector CN3. The electric circuit units M1 and M2 are electric circuit modules. Thus, the electric circuit units M1 and M2 can easily be attached/detached via the connectors CN1 to CN3.

As the push-type switch sw1 is turned on, a contact point sw1*a* is closed and power is supplied to the coil of a relay 11. In response, the connection of the relay 11 is switched from a contact point a1 to a contact point b1 and, as a result, the solenoid SL1 becomes excited. Consequently, the rotating body motor starts to rotate forward, thereby causing a forward rotation of the rotating body 62. If, on the other hand, the push-type switch sw2 is turned on, the contact point sw2*a* is closed and power is supplied to the coil of a relay 12. Consequently, the connection of the relay 12 is switched from a contact point a2 to a contact point b2 and thus, the solenoid SL2 becomes excited. In this case, the rotating body motor starts to rotate in the reverse direction, causing a reverse rotation of the rotating body 62.

As the switch sw1 in an ON state is turned off, the contact point sw1*a* becomes open. This switches the connection of the relay 11 to the contact point a1 and the solenoid SL1 becomes demagnetized. As a result, the rotation of the rotating body motor stops, thereby stopping the rotating body 62 as well. It is to be noted that the rotation of the rotating body 62 is stopped in a similar manner when the switch sw2 in an ON state is turned off. As described above, according to the basic specifications, a drive command for driving the rotating body motor is output by operating the switch sw1 or sw2.

It is to be noted that the structures of the operation circuits used to operate the switches sw3 and sw4 and the switches sw5 and sw6 at the operation lever 8B are similar to that shown in FIG. 4 and these operation circuits engage in operation similar to that of the operation circuit in FIG. 4. Namely, as the switch sw3 at the operation lever 8B is turned on, the cover motor is caused to rotate forward, whereas when the switch sw4 at the operation lever 8B is turned on, the cover motor is caused to rotate in the reverse direction. As a result, the rotating body 62 is caused to rotate around the axial line L1, changing the orientation of the rotating body 62 relative to the vehicle body. As the switch sw5 at the operation lever 8B is turned on, the right tilt cylinder extends and, at the same time, the left tilt cylinder contracts, whereas if the switch sw6 is turned on, the left tilt cylinder extends and the right tilt cylinder contracts. This causes the rotating body 62 to swing to the left/right relative to the bracket 5, changing the tilt angle of the rotating body 62 relative to the vehicle body.

A mowing operation may be executed as described below, for instance, according to the basic specifications. First, the hydraulic shovel is made to travel to a mowing operation start position. Then, the cylinders 4*a* to 4*c* are driven by operating the operation levers 8A and 8B so as to set the mower main unit 6 at a specific work position. In addition, the switches sw3/sw4 and the switches sw5/sw6 at the operation lever 6B are operated to respectively drive the cover motor and the tilt cylinders, so as to adjust the orientation and the tilt angle of the rotating body 62 relative to the vehicle body. The switch sw1 at the operation lever 8A is turned on in this state, thereby causing a forward rotation of the rotating body 62. As the rotating body 62 rotates forward, the traveling superstructure 1 and the cylinders 4*a* to 4*c* are driven to move the rotating body 62 along a specific work direction, thereby engaging the work vehicle in a mowing operation. As the switch sw1 is turned off and the switch sw2 is turned on at the operation lever 8A, the rotating body 62 rotates in the reverse direction to allow removal of grass packed inside the cover 61 and the like.

(2) Modified Specifications

Figure 5:
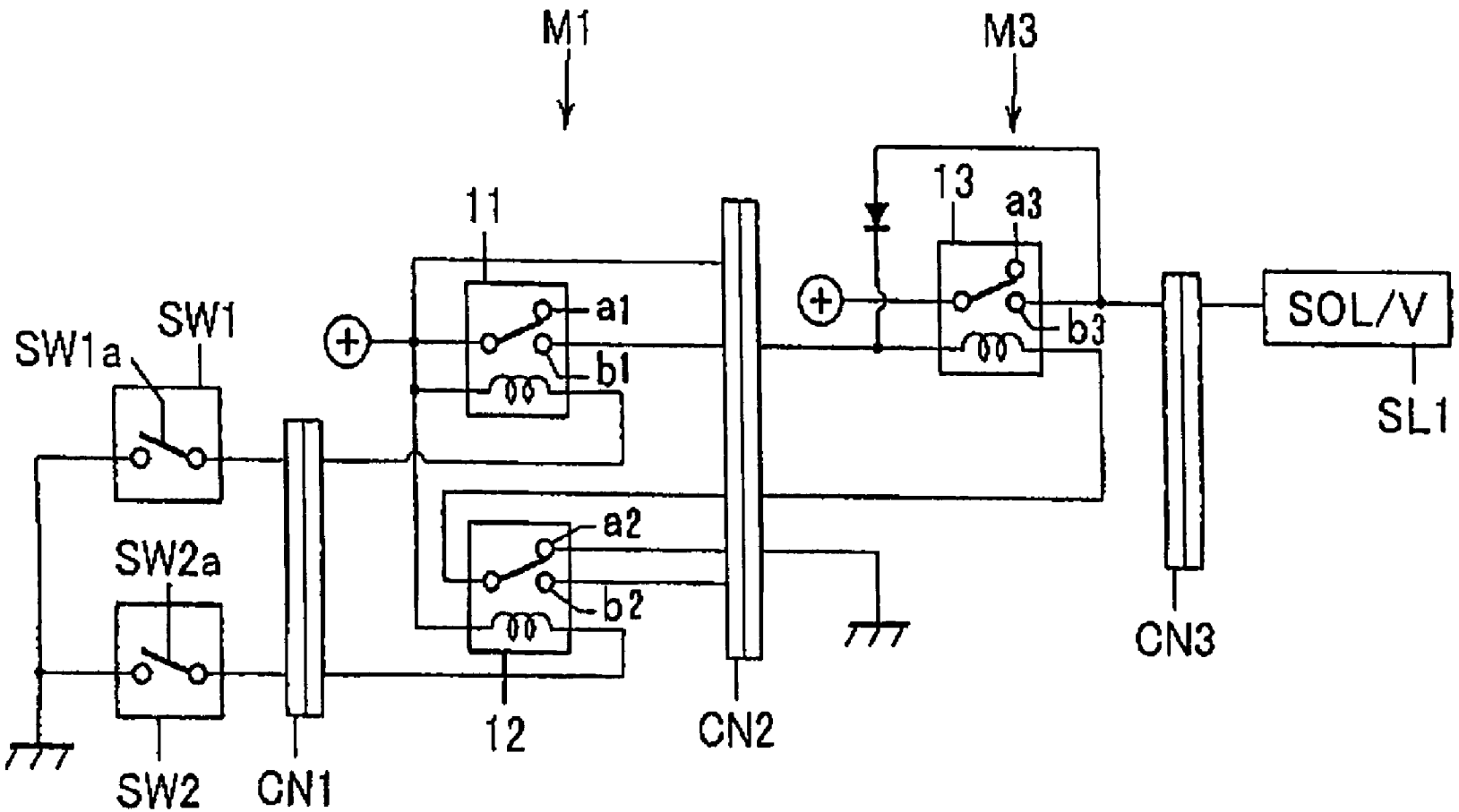
FIG. 5 presents an example of a change in the operation circuit shown in FIG. 4.

FIG. 5 presents an example of a modification made in the specifications of the operation circuit. The operation circuit in FIG. 5 constitutes a self-holding circuit that sustains an output of a drive command even if the operator subsequently lets go of the switch sw1 after operating the switch sw1 once. It is to be noted that FIG. 5 shows a circuit capable of rotating the rotating body 62 along a single direction (the forward direction) only.

As shown in FIG. 5, an electric circuit unit M3 having a relay circuit instead of the electric circuit unit M2, is connected via the connector CN2 to the electric circuit unit M1. The solenoid SL1 for motor forward rotation is connected via the connector CN3 to the electric circuit unit M3. The electric circuit unit M3 is an electric circuit module.

As the switch sw1 is turned on, power is supplied to the coil at the relay 11 and, in response, the connection of the relay 11 is switched from the contact point a1 to the contact point b1. Thus, power is supplied to the coil at a relay 13, thereby switching the connection of the relay 13 from a contact point a3 to a contact point b3, and thus, the solenoid SL1 becomes excited. If the ON operation of the switch sw1 ends at this point, the connection of the relay 11 is switched to the contact point a1. However, the self-holding circuit achieved with the connection with the contact point b3 at the relay 13 sustains the power supply to the coil at the relay 13. Namely, after the switch sw1 is initially operated, the solenoid SL1 is continuously excited and the rotating body 62 keeps rotating even if the operator subsequently lets go of the switch sw1. As a result, the ease of operation is improved since the mowing operation can be continuously performed without having to hold down the switch.

As the switch sw2 is turned on while the rotating body 62 rotates, power is supplied to the coil at the relay 12 thereby switching the connection of the relay 12 from the contact point a2 to the contact point b2. In response, the power supply to the coil at the relay 13 stops and the connection of the relay 13 is switched to the contact point a3, causing the solenoid SL1 to become demagnetized. As a result, the rotation of the rotating body 62 stops.

By replacing the electric circuit unit M2 used in the basic specifications with the electric circuit unit M3 as described above, an operation signal adopting a different mode can be generated through a single switch. Namely, the push-type function of the switch sw1 can be modified with ease to a self-holding function.

Figure 6:
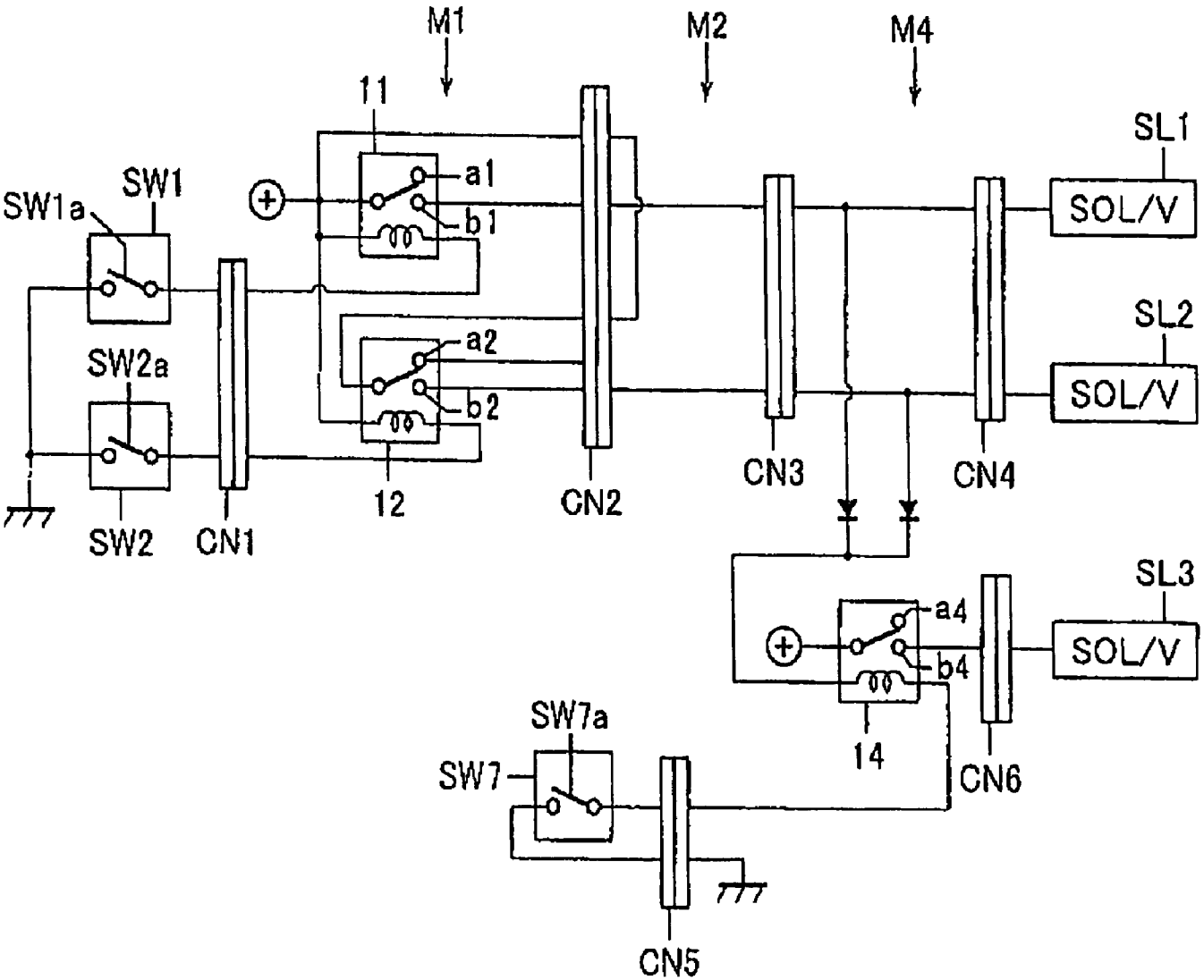
FIG. 6 presents another example of a change in the operation circuit shown in FIG. 4.

FIG. 6 presents another example of an operation circuit conforming to modified specifications. As shown in FIG. 6, an electric circuit unit M4 achieved as an electric circuit module is connected between the connector CN3 and a connector CN4, i.e., between the electric circuit unit M2 in the basic specifications (see FIG. 4) and the solenoids SL1 and SL2. A switch sw7 is connected via a connector CN5 to the electric circuit unit M4 and also, a solenoid SL3 is connected via a connector CN6 to the electric circuit unit M4.

The solenoid SL3 is utilized for a deceleration electromagnetic switching valve used, for instance, to reduce the quantity of oil supplied from the hydraulic pump to the rotating body motor. The switch sw7 may be, for instance, a toggle switch disposed at the operation panel in the operator's cab. As the switch sw7 is turned on, a contact point sw7*a* is closed, whereas the contact point sw7*a* is opened if the switch sw7 is turned off. It is to be noted that the switch sw7 may be a push-type switch and, in such a case, the switch sw5 at the operation lever 8B may be used as the switch sw7.

FIG. 6 indicates that as the switch sw1 is turned on, the solenoid SL1 becomes excited, whereas as the switch sw2 is turned on, the solenoid SL2 becomes excited. Under such circumstances, if the switch sw7 is in an OFF state, the connection with a contact point a4 is achieved at a relay 14 and the solenoid SL3 becomes demagnetized. As a result, a standard quantity of pressure oil is supplied to the rotating body motor causing the rotating body 62 to rotate at high speed (in a high-speed mode). If, on the other hand, the switch sw7 is in an ON state, power is supplied to the coil at the relay 14 in response to an ON operation of the switch sw1 or sw2, thereby switching the connection of the relay 14 to a contact point b4. As a result, the solenoid SL3 becomes excited, the quantity of pressure oil supplied to the rotating body motor becomes reduced and thus, the rotating body 62 rotates at low speed (in a low-speed mode).

As described above, the operation circuit in FIG. 6 is achieved by modifying the operation circuit conforming to the basic specifications, with the electric circuit unit M4 connected between the connectors CN3 and CN4, and the switch sw7 and the solenoid SL3 respectively connected via the connectors CN5 and CN6 to the electric circuit unit M4. This structure allows a plurality of solenoids SL1 and SL3 to become excited at once in response to an operation of the switch sw1 and also allows a plurality of solenoids SL2 and SL3 to become excited at once in response to an operation of the switch sw2. As a result, it becomes possible to output a speed command (deceleration command) as well as a rotation command for the rotating body 62. In other words, the functions of the switches sw1 and sw2 are modified so as to output a plurality of operation signals in response to a single switch operation, and thus, a deceleration circuit can be achieved with ease.

Figure 7:
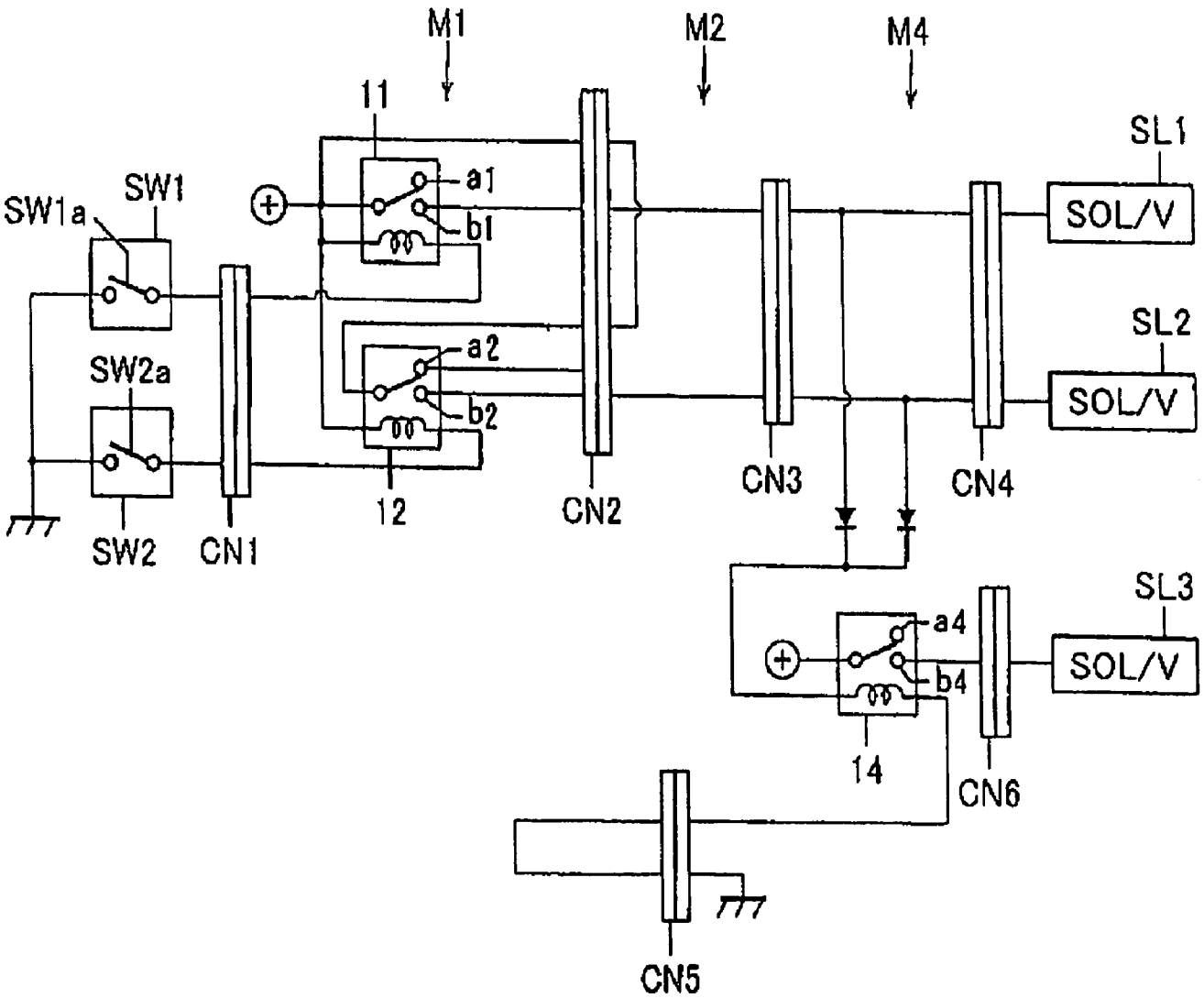
FIG. 7 presents yet another example in which the operation circuit shown in FIG. 6 is further changed.

It is to be noted that the specifications of the mower main unit 6 may be permanently set in the low-speed mode by forming the circuit as shown in FIG. 7 so as to short the terminals of the switch sw7 on both sides. Since the switch sw7 is no longer needed, the structure becomes simplified. While the solenoid SL3 is utilized for the deceleration electromagnetic switching valve in FIG. 6, the solenoid SL3 may be used to drive another actuator. In such a case, a drive command for driving another actuator can be output in addition to the drive command for the rotating body motor through a single switch operation and thus, a plurality of actuators can be driven at once.

The electric circuit unit M3 shown in FIG. 5 may be connected in place of the electric circuit unit M2. Since the rotating body 62 keeps rotating once the switch sw1 is operated until the switch sw2 is operated, the rotating speed of the rotating body 62 can be easily adjusted through an ON/OFF operation of the switch sw3 in this case.

Figure 8:
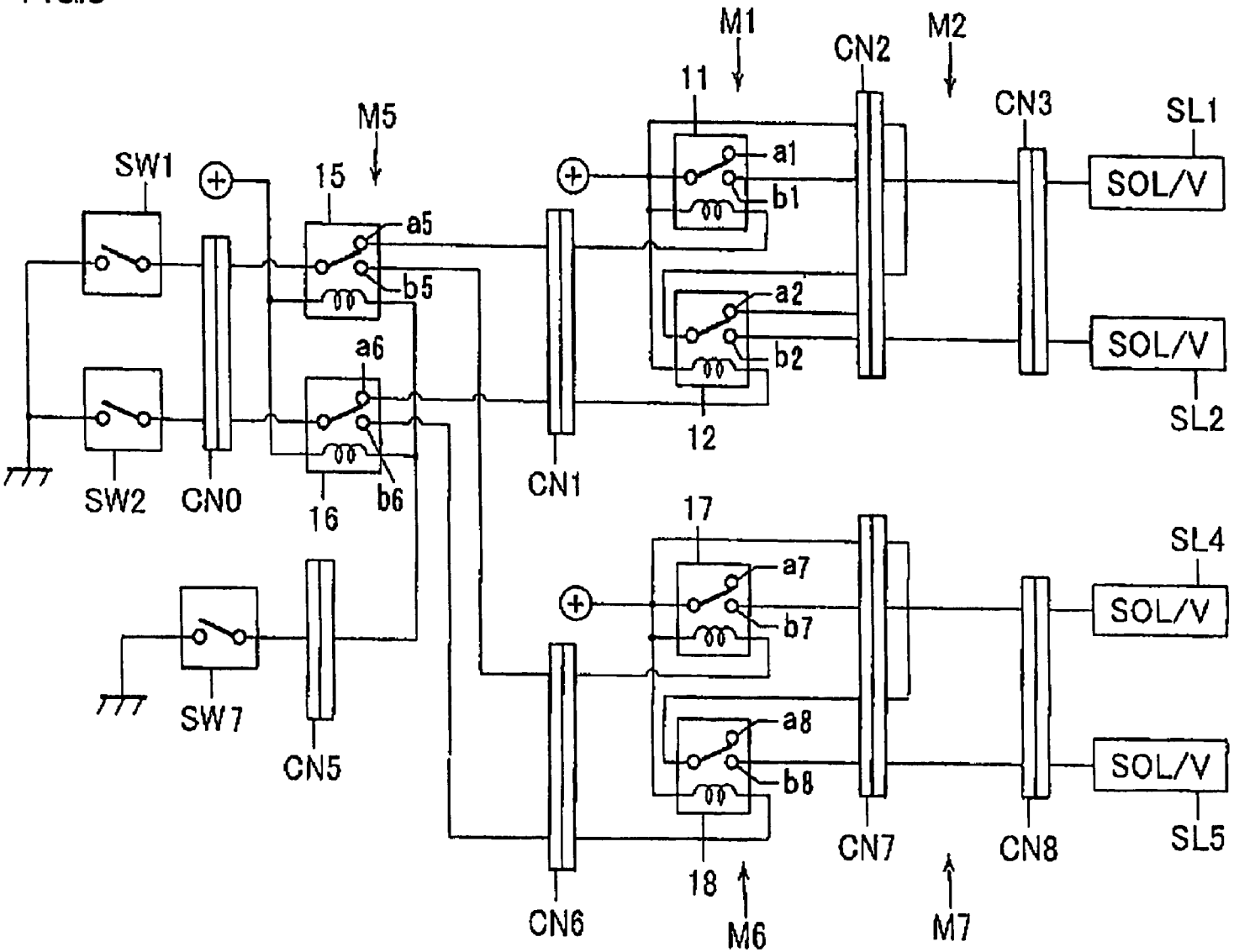
FIG. 8 presents yet another example of a change in the operation circuit shown in FIG. 4.

FIG. 8 presents yet another example of an operation circuit conforming to modified operation specifications. The structure in FIG. 8 is achieved by altering the operation circuit conforming to the basic specifications (see FIG. 4), with an electric circuit unit M5 achieved as an electric circuit module connected via connectors CN0 and CN1 between the switches sw1 and sw2 and the electric circuit unit M1.

The switch sw7 is connected via the connector CN5 to the electric circuit unit M5 and also, an electric circuit unit M6 is connected via a connector CN6 to the electric circuit unit M5.

An electric circuit unit M7 is connected via a connector CN7 to the electric circuit unit M6. Solenoids SL4 and SL5 are in turn connected via a connector CN8 to the electric circuit unit M7. The structures of the electric circuit units M6 and M7 are identical to the structures of the electric circuit units M1 and M2 respectively. The solenoids SL4 and SL5 may be used as, for instance, the solenoids for driving the tilt cylinders, and the switch sw7 is the toggle switch explained earlier.

In FIG. 8, as the switch sw1 is burned on while the switch sw7 is in an OFF state, power is supplied to the coil at the relay 11, thereby switching the connection of the relay 11 from the contact point a1 to the contact point b1. As a result, the solenoid SL1 becomes excited, causing the rotating body 62 to rotate forward. In addition, if the switch sw2 is turned on while the switch sw7 is in an OFF state, power is supplied to the coil at the relay 12, thereby switching the connection of the relay 12 from the contact point a2 to the contact point b2. In response, the solenoid SL2 becomes excited, causing a reverse rotation of the rotating body 62.

If the switch sw7 is turned on, power is supplied to coils at relays 15 and 16, switching the connections at the relays 15 and 16 respectively to contact points b5 and b6. As the switch sw1 is turned on in this state, power is supplied to a coil at a relay 17, switching the connection of the relay 17 to a contact point b7. As a result, the solenoid SL4 becomes excited, causing the rotating body 62 to swing to one side. If, on the other hand, the switch sw2 is turned on while the switch sw7 is in an ON state, power is supplied to a coil at a relay 18, thereby switching the connection of the relay 18 to a contact point b8. In response, the solenoid SL5 becomes excited, causing the rotating body 62 to swing to the opposite side.

As described above, the operation circuit shown in FIG. 8 is achieved by modifying the operation circuit conforming to the basic specifications, with the electric circuit unit M5 connected via the connectors CN0 and CN1, and with the switch sw7, the electric circuit units M6 and M7 and the solenoids SL4 and SL5 connected to the electric circuit unit M5 respectively via the connectors CN5 to CN8. As a result, the solenoid SL1 or the solenoid SL4 is excited in response to an operation of the switch sw1, and the solenoid SL2 or the solenoid SL5 is excited in response to an operation of the switch sw2. This structure, in which the switches sw1 and sw2 are each used as a rotating body motor drive switch and a tilt cylinder drive switch, allows the number of switches to be reduced.

It is to be noted that while either a rotating body motor drive command or a tilt cylinder drive command is output in the operation circuit shown in FIG. 8, an operation circuit in which either a rotating body motor drive command, a tilt cylinder drive command or a cover motor drive command, for instance, is output may be formed by incorporating another drive operation circuit (the operation circuit through which the cover motor drive command is output) in the structure shown in FIG. 8. In such a case, instead of the ON/OFF type switch sw7, a dial type switch should be used to constitute a selector switch which is operated to select the drive of a specific actuator.

The operation circuits in the embodiments described above are achieved by modifying the operation circuit (see FIG. 4) conforming to the work actuator basic specifications, with the electric circuit units M3 to M7 added to the basic operation circuit structure via the connectors CN0 to CN8 (see FIGS. 5 to 8). In any of these changed operation circuits, an operation signal adopting a mode different from the mode of an operation signal generated in the operation circuit conforming to the basic specifications can be generated to achieve a modification in the switch function with ease.

When the terminal connections are modified within the circuit simply by, for instance, inserting a connector, only the correspondence between the switches and the solenoids is changed and the switch functions themselves remain unchanged. In addition, it is a costly and time-consuming proposition to manufacture completely different operation circuits from scratch. The operation circuits achieved in the embodiments, in contrast, the structures of which are varied by attaching/detaching the electric circuit units M1 to M7 each having a relay circuit or the like, make it possible to modify the switch functions with ease, e.g., from a switch operated to excite a specific solenoid to another type of switch.

It is to be noted that as examples of switch function modifications, a self holding switch (FIG. 5), switches operated to excite a plurality of solenoids at once (FIGS. 6 and 7) and a switch operated to excite a solenoid among a plurality of solenoids (FIG. 8) are achieved in the individual embodiments explained above. However, a structure other than these described in reference to the embodiments may be adopted to modify the switch function.

In the explanation provided above, the operation circuit (the first operation circuit) conforming to the basic specifications includes the electric circuit units M1 and M2. Alternatively, the first operation circuit may be achieved by omitting the operation circuits M1 and M2 and simply by connecting the switches sw1 and sw2 with the solenoids SL1 and SL2 via a connector. In addition, while the electric circuit units M3 to M5 added to the operation circuit conforming to the basic specifications to modify the structure thereof are relay circuits, the electric circuit units M3 to M5 may each be constituted by using an electric component other than a relay, as long as the electric circuit unit is capable of outputting an operation signal in a different mode. The operation circuit (the first operation circuit) conforming to the basic specifications and the modified operation circuit (the second operation circuit) are not limited to the examples explained above. An electromagnetic actuator other than a solenoid may be used as long as it is driven by an operation signal corresponding to a switch operation and the work actuator is driven in response to the drive of the electromagnetic actuator.

While the present invention is adopted in a mowing machine in the embodiments described above, it may also be adopted in other types of work vehicles. Namely, the types of work actuators in conjunction with which the present invention is adopted are not limited to that explained earlier, and the present invention may be adopted in operation circuits other than those achieved in the embodiments as long as the features and functions of the present invention are realized in full.

The disclosure of the following priority application is herein incorporated by reference:

Japanese Patent Application No. 2003-405683, filed Dec. 4, 2003

What is claimed is:

1. An operation circuit for a work vehicle, comprising:

a switch device;

an electromagnetic actuator driven in response to a command signal issued through the switch device;

a work actuator driven by the electromagnetic actuator;

at least one electric circuit module disposed between the switch device and the electromagnetic actuator, which controls driving the electromagnetic actuator in response to a command signal issued through the switch device; and a connector device that individually and detachably connects the switch device with the electric circuit module and the electric circuit module with the electromagnetic actuator, wherein:

a mode in which the electromagnetic actuator is driven in response to the command signal from the switch device is modified (1) by replacing the electric circuit module with another electric circuit module via the connector device to change the operation circuit and alter the command signal or (2) by attaching another electric circuit module via the connector device to the electric circuit module to change the operation circuit and alter the command signal; and each electric circuit module includes a relay circuit.

2. An operation circuit for a work vehicle according to claim 1, wherein:

the operation circuit is changed between a first operation circuit and a second operation circuit; and a drive command for driving the work actuator is output while an operation of the switch device is sustained in the first operation circuit, and a drive command for driving the work actuator is continuously output once an operation of the switch device is performed even if the switch operation of the switch device stops in the second operation circuit.

3. An operation circuit for a work vehicle according to claim 1, wherein:

the operation circuit is changed between a first operation circuit and a second operation circuit;

an operation signal to demand a specific operation of the work actuator in response to an operation of the switch device is output to the electromagnetic actuator in the first operation circuit; and an operation signal to demand another specific operation of the work actuator along with the specific operation of the work actuator in response to an operation of the switch device is output to the electromagnetic actuator in the second operation circuit.

4. An operation circuit for a work vehicle according to claim 1, further comprising:

a selector switch operated to select driving a single work actuator among a plurality of work actuators, wherein:

the operation circuit is changed between a first operation circuit and a second operation circuit;

a command to demand an operation of the work actuator, determined in advance in response to an operation of the switch device, is output to the electromagnetic actuator in the first operation circuit; and a command to demand an operation of the work actuator, selected by the selector switch in response to an operation of the switch device, is output to the electromagnetic actuator in the second operation circuit.

* * * * *